United States Patent [19]

Sakamoto et al.

[11] Patent Number: 4,716,871

[45] Date of Patent: Jan. 5, 1988

[54] INTAKE SYSTEM FOR ENGINE

[75] Inventors: Katsuhiko Sakamoto; Tetsushi Hosokai; Hideo Shiraishi, all of Hiroshima, Japan

[73] Assignee: Mazda Motor Corporation, Japan

[21] Appl. No.: 892,041

[22] Filed: Aug. 1, 1986

[30] Foreign Application Priority Data

Aug. 2, 1985 [JP] Japan ..... 60-171464

[51] Int. Cl.[4] ..... F02M 3/12

[52] U.S. Cl. ..... 123/339; 123/588; 123/587

[58] Field of Search ..... 123/339, 585, 587, 588

[56] References Cited

U.S. PATENT DOCUMENTS

| | | | |
|---|---|---|---|
| 4,425,886 | 1/1984 | Kuroiwa et al. | 123/588 X |
| 4,484,553 | 11/1984 | Kobayashi et al. | 123/339 |
| 4,562,808 | 1/1986 | Tominaga et al. | 123/339 |
| 4,563,989 | 1/1986 | Peter | 123/339 |

FOREIGN PATENT DOCUMENTS

| | | |
|---|---|---|
| 0098413 | 8/1979 | Japan . |
| 0162340 | 9/1984 | Japan . |

*Primary Examiner*—Willis R. Wolfe, Jr.

*Attorney, Agent, or Firm*—Gerald J. Ferguson, Jr.; Michael P. Hoffman; Michael J. Foycik, Jr.

[57] ABSTRACT

In an intake system having a bypass passage for introducing auxiliary air to the engine, a base amount of auxiliary air is first determined according to the engine operating condition. A target idling speed is calculated according to the engine temperature and the engine load and the target idling speed is compared with the actual engine speed. The base amount of auxiliary air is corrected according to the difference between the target idling speed and the actual engine speed, thereby obtaining a final target amount of auxiliary air. The control amount of the control valve is determined according to the final target amount of auxiliary air referring the final target amount of auxiliary air to the output characteristics of the control valve. Then the control valve is driven on the basis of the control amount.

13 Claims, 9 Drawing Figures

INTAKE SYSTEM FOR ENGINE

BACKGROUND OF THE INVENTION

1. Field of the Invention

This invention relates to an intake system for an internal combustion engine, and more particularly to an intake system for an internal combustion engine having a bypass air control system for controlling the amount of auxiliary air to be introduced into the combustion chamber bypassing the throttle valve in the intake passage.

2. Description of the Prior Art

As disclosed in Japanese Unexamined Patent Publication Nos. 54(1979)-98413 and 59(1984)-162340, for instance, there has been known an intake system for an internal combustion engine having a bypass air control system, that is, an intake system which is provided with a bypass passage bypassing the throttle valve in the intake passage to feed auxiliary air to the engine during idling, a control valve for opening and closing the bypass passage and a control means for controlling the control valve according to the operating condition of the engine such as the engine temperature, the engine load and the like, and in which the amount of air-fuel mixture to be introduced into the engine is controlled to control the engine speed according to the operating condition of the engine, thereby effecting feedback control of the idling speed, correction of the idling speed according to load on the engine or the like.

The following problems are in the intake system having such a bypass air control system. That is, the output characteristics of the control valve, i.e., the relation of the electric current for driving the control valve to the amount of air flowing through the bypass passage, is nonlinear as shown in FIG. 9. That is, the output characteristic curve of the control valve has a relatively small inclination at the marginal parts where the duty are near 0% or 100% and has a relatively large inclination at the intermediate part, the intermediate part being substantially linear. Therefore, the change in the amount of auxiliary air for a given change of the duty of the control valve varies depending on the original position of the control valve. This adversely affect the precision of control. The original position of the control valve changes with time or depending on whether the engine is loaded. If the control is effected using only the intermediate part of the output characteristic curve of the control valve in order to avoid the problem, useful range of the control valve is remarkably narrowed for the capacity thereof, and the engine is apt to stall due to disturbance. Otherwise, the control valve must be very large in capacity.

SUMMARY OF THE INVENTION

In view of the foregoing observations and description, the primary object of the present invention is to provide an intake system for an internal combustion engine having a bypass air control system in which the amount of auxiliary air fed to the engine through the bypass passage can be precisely controlled to a value optimal to control the idling speed to a desired value irrespective of the linearity of the output characteristics of the control valve without enlarging the control valve in size and volume.

In accordance with the present invention, as shown in FIG. 1, a base amount of auxiliary air is first determined according to the engine operating condition such as the engine temperature. The base amount of auxiliary air is corrected according the engine load when the engine is loaded. A target idling speed is calculated according to the engine temperature and the engine load and the target idling speed is compared with the actual engine speed. The corrected base amount of auxiliary air, or the auxiliary air requirement is corrected according to the difference between the target idling speed and the actual engine speed, thereby obtaining a final target amount of auxiliary air. If necessary, the auxiliary air requirement corrected according to the difference between the target idling speed and the actual engine speed may be further corrected with learning correction amount of air. The control amount of the control valve is determined according to the final target amount of auxiliary air referring the final target amount of auxiliary air to the output characteristics of the control valve. Then the control valve is driven on the basis of the control amount.

Thus, in the present invention, a target amount of auxiliary air is first calculated according to the engine operating condition and the controlled variable, (e.g., control duty) of the control valve is determined according to the target amount of auxiliary air based on the output characteristics of the control valve (the relation of the flow rate of auxiliary air to the controlled variable of the control valve). Accordingly, the target amount of auxiliary air can be precisely introduced into the engine through the bypass passage irrespective of the linearity of the control valve or the initial position of the control valve. Further, since substantially over the entire output characteristics of the control valve can be used in accordance with the present invention, the control valve may be small in size and volume, and at the same time, the engine can be prevented from stalling due to disturbance.

In accordance with a preferred embodiment of the present invention, a base mass of auxiliary air is first determined according to the engine operating condition including the engine temperature, the engine load and the like. A target idling speed is calculated according to the engine temperature and the engine load and the target idling speed is compared with the actual engine speed. The base mass of auxiliary air is corrected according to the difference between the target idling speed and the actual engine speed, thereby obtaining a final target mass of auxiliary air. The final target mass of the auxiliary air is converted into a target amount of auxiliary air taking into account the density of the air which can be detected through the temperature of intake air, for instance. The control amount of the control valve is determined according to the target amount of auxiliary air referring the target amount of auxiliary air to the output characteristics of the control valve. Then the control valve is driven on the basis of the control amount.

This arrangement is advantageous in that the engine speed can be quickly converged on the target idling speed irrespective of the air density which substantially affects the engine output power.

DESCRIPTION OF THE PREFERRED EMBODIMENT

Figure 1:
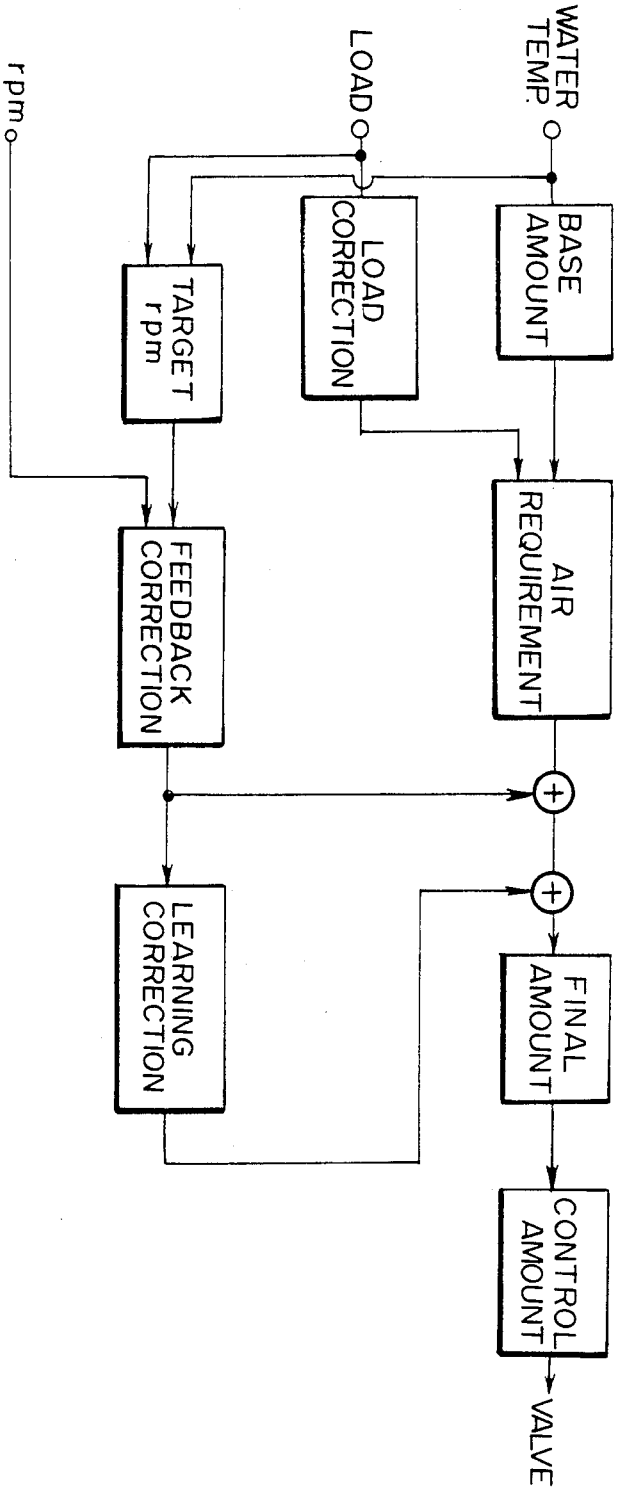
FIG. 1 is a block diagram for illustrating the principle of the present invention.
Figure 2:
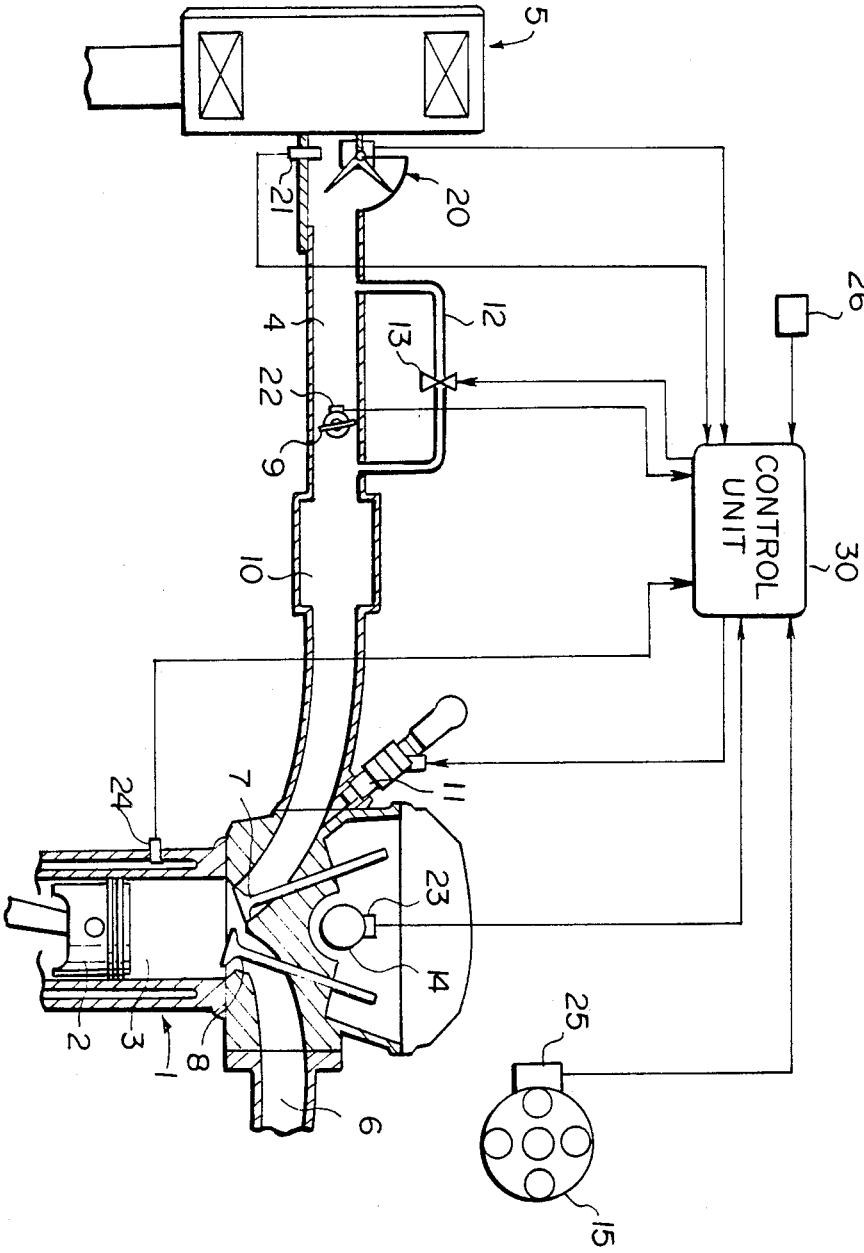
FIG. 2 is a schematic view of an internal combustion engine provided with an intake system in accordance with an embodiment of the present invention.

In FIG. 2 showing an internal combustion engine provided with an intake system in accordance with an embodiment of the present invention, reference numeral 1 denotes the engine having a combustion chamber 3 in which a piston 2 is received for sliding motion therein. An intake passage 4 opens to the atmosphere by way of an air cleaner 5 at the upstream end and to the combustion chamber 3 at the downstream end. An exhaust passage 6 opens to the atmosphere at the downstream end and to the combustion chamber 3 at the upstream end. The intake passage 4 is provided with an intake valve 7 and the exhaust passage 6 is provided with an exhaust valve 8.

A throttle valve 9 is provided in the intake passage 4 to control the amount of intake air, and the a surge tank 10 is provided in the intake passage 4 downstream of the throttle valve 9. Further a fuel injection valve 11 is disposed downstream of the surge tank 10. A bypass passage 12 is provided to communicate with a portion of the intake passage 4 upstream of the throttle valve 9 at one end and with a portion of the intake passage 4 downstream of the throttle valve 9 at the other end. The bypass passage 12 is provided with a control valve 13 for opening and closing the bypass passage 12 to control the amount of auxiliary air to be introduced into the combustion chamber 3 through the bypass passage 12 bypassing the throttle valve 9.

An airflow sensor 20 for detecting the amount of intake air and an intake air temperature sensor 21 for detecting the temperature of intake air ($T_{HA}$) are disposed in the intake passage 4 upstream of the throttle valve 9. Reference numerals 20 to 26 respectively denote a throttle opening sensor which detects the position of the throttle valve 9, i.e., the throttle opening, and is provided with a built-in idle switch for detecting that the engine 1 idles through the fact that the throttle valve 9 is fully closed, a crank angle sensor for detecting the crank angle through the angular position of the camshaft 14, a water temperature sensor for detecting the temperature of the engine 1 through the temperature $T_{HW}$ of the engine cooling water, an engine speed sensor which is provided to be associated with a distributor 15 to detect the engine speed Ne, and an atmospheric pressure sensor for detecting the atmospheric pressure $B_{AR}$. The outputs of the sensors 20 to 26 are input into a control unit 30 (which is of a CPU (central processor unit), for instance) for controlling the fuel injection valve 11 and the control valve 13. The control unit 30 controls the fuel injection valve 11 to control the amount of fuel to be injected from the injection valve 11 according to the engine operating condition, and controls the flow of auxiliary air through the bypass passage 12 by duty control of the control valve 13.

Figure 3:
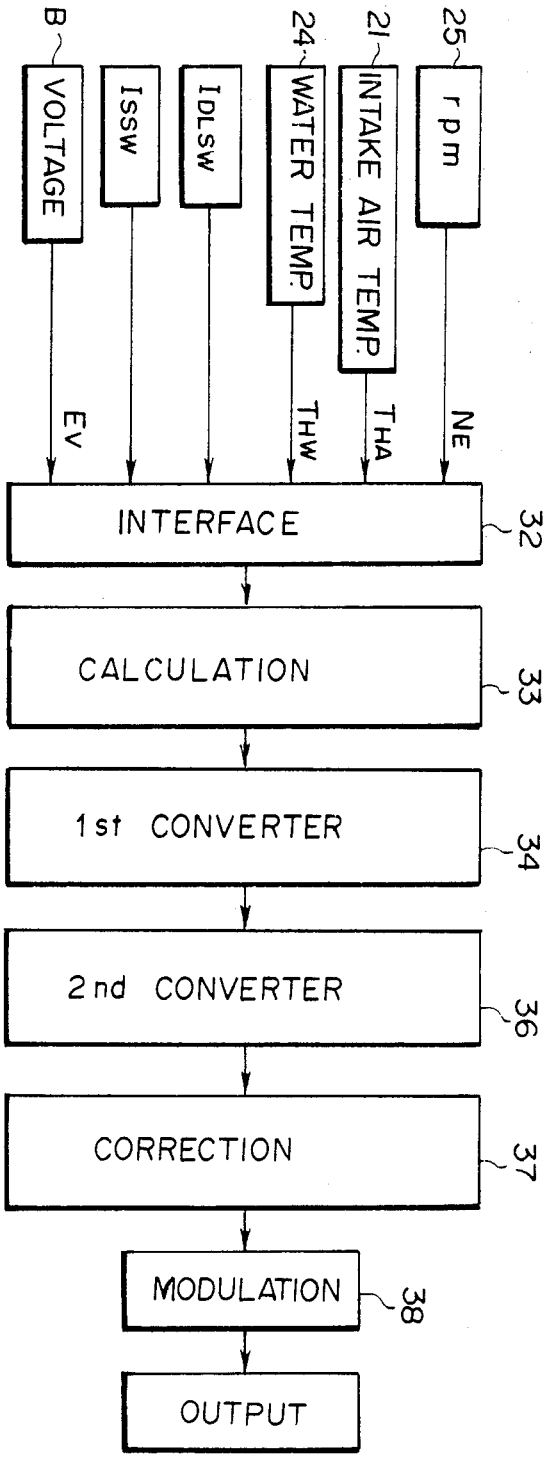
FIG. 3 is a block diagram of the control unit employed in the intake system.

The duty control of the control valve 13 by the control unit 30 will be described in detail with reference to FIG. 3, hereinbelow. The control unit 30 includes a calculating circuit 33 which receives a engine speed signal from the engine speed sensor 25, an intake air temperature signal from the intake air temperature sensor 21, an water temperature signal from the water temperature sensor 24, an idle signal from the idle switch $I_{DLSW}$, an initial set signal from an initial set switch $I_{SSW}$ which is turned on when idle control is to be effected, and a battery voltage signal representing the voltage of a battery B by way of an interface 32, and calculates a target mass flow rate of auxiliary air $G_A$ according to the engine operating condition. The control unit 20 further includes a first converter circuit 34 which converts the target mass flow rate $G_A$ into a volume flow rate to obtain a target volume flow rate of auxiliary air Qa according to the engine operating condition, a second converter circuit 36 which converts the target volume flow rate Qa into an energizing time (duty) of the control valve 13 based on a map, table or function representing the output characteristics (characteristics of duty to the volume flow rate of auxiliary air) of the control valve 13 determined in advance, a correction circuit 37 which corrects the output current of the second converter circuit 36 according to the battery voltage and the water temperature (the temperature of the winding), and a modulator circuit 38 which modulates the output current corrected by the correction circuit 37 to prevent hunting of the control valve 13 and delivers it to the control valve 13.

The operating range in which duty control of the control valve 13 is to be effected is divided into an initial set zone, that is, a zone in which the amount of auxiliary air is to be controlled to control the idling speed (when the initial set switch $I_{SSW}$ is on), a starting zone in which the engine is being cranked (the engine speed is not higher than 500 rpm), an after-starting zone from the time the engine starts operate by itself without the aid of the starter to the time the engine speed reaches the idling speed (that is, when neither $G_{SA}$ nor $G_{SW}$ to be described later is equal to 0), an idling speed feedback zone in which the engine is idling (the idle switch IDLSW is on) and feedback control is to be effected to converge the idling speed on a target engine speed No and a fixed zone, that is, a zone outside these zones.

The target mass flow rate of auxiliary air $G_A$ is calculated according to the zones described above, and is set to $G_{IS}$ ($G_A = G_{IS}$ . . . constant) in the initial set zone, and is calculated based on the following formula in the other zones.

$$G_A = G_B + G_{SW} + G_{SA} + G_L + G_{FB} + G_{LRN}$$

wherein $G_B$, $G_{SW}$, $G_{SA}$, $G_L$, $G_{FB}$, and $G_{LRN}$ respectively represent a base amount of air, a starting increase of air, a high intake air temperature correction amount of air, a load correction amount of air, an idling speed feedback correction amount of air and a learning correction amount of air and will be described in detail, hereinbelow.

Figure 4:
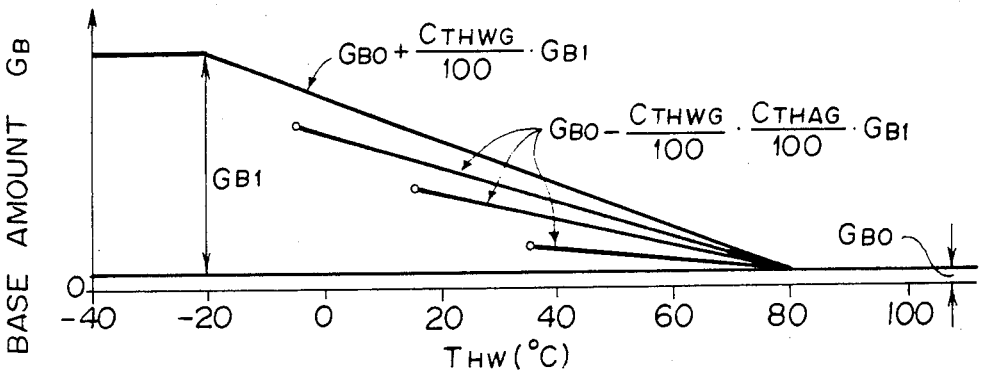
FIG. 4 is a characteristic diagram showing the relation between the cooling water temperature and the base amount of air $G_B$.

1. The base amount of air $G_B$ is a base of calculation of the amount of auxiliary air and is obtained from the following formula.

$$G_B = G_{BO} + (C_{THWG}/100) \times (C_{THAG}/100) \times G_{Bl} + G_{LSDR}$$

wherein $G_{BO}$ represents a base amount of air obtained by subtracting the amount of air passing through the throttle valve from the amount of air required during idling when the engine is warm, $(C_{THWG}/100)$ represents a correction coefficient for the temperature of the engine cooling water $T_{HW}$, $(C_{THAG}/100)$ represents a correction coefficient for the temperature of intake air $T_{HA}$, i.e., the oil temperature upon starting, and $G_{Bl}$ represents a maximum increase of air for warm-up, $(C_{THWG}/100) \times (C_{THAG}/100) \times G_{Bl}$ representing the increase of air for warm-up when the engine is cold. The values of $G_{BO}$ and $G_{Bl}$ in the case of a manual transmission vehicle and in the case that the transmission is in a range other than D-range in an automatic transmission vehicle differ from the values of $G_{BO}$ and $G_{Bl}$ in the case that the transmission is in D-range in an automatic transmission vehicle, the latter being larger than the former. $G_{LSDR}$ represents a oneshot air increase by which the amount of auxiliary air is corrected for, for instance, 500 ms when the automatic transmission is shifted from N-range to D-range in order to prevent drop in the engine speed. The relation between the base amount of air $G_B$ and the temperature of the engine cooling water $T_{HW}$ is as shown in FIG. 4 and when the temperature of the engine cooling water $T_{HW}$ is detected, the base amount of air $G_B$ can be obtained. In FIG. 4, the oneshot air increase $G_{LSDR}$ is omitted.

2. The starting increase of air $G_{SW}$ represents the amount of air to be increased in order to smoothly start the engine and the high intake air temperature correction amount of air $G_{SA}$ represents the amount of air to be increased during starting according to the temperature of intake air in order to compensate for reduction of the air density due to increase in the intake air temperature. The starting increase of air $G_{SW}$ and the high intake air temperature correction amount of air $G_{SA}$ are kept at respective constant values in the starting zone, and when the operating range moves to the after-starting zone, they are gradually reduced to be finally nullified.

Figure 5:
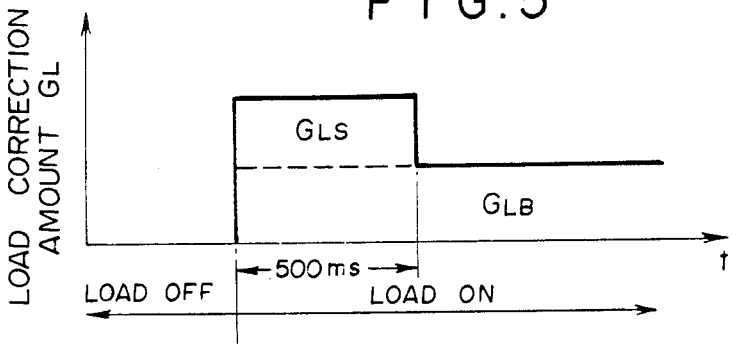
FIG. 5 is a characteristic diagram of the load correction amount of air $G_L$.

3. The load correction amount of air $G_L$ is an amount of air to be increased according to load when the engine is loaded and is obtained from the following formula.

$$G_L = G_{LB} + G_{LS}$$

wherein $G_{LB}$ represents a base amount of the load correction and $G_{LS}$ represents a oneshot air increase by which the amount of auxiliary air is corrected for, for instance, 500 ms when the engine is loaded in order to prevent drop in the engine speed. Thus, the load correction amount of air $G_L$ has characteristics shown in FIG. 5. The engine load includes air-conditioner load, power steering system load, electric load and the like, and when two or more loads are exerted on the engine, the load correction amounts of air $G_L$ for the respective loads are added.

4. The idling speed feedback correction amount of air $G_{FB}$ represents an amount of air to be increased or reduced according to the difference $\Delta Ne$ between the actual engine speed Ne and the target idling speed No ($\Delta Ne = No - Ne$) and is obtained from the following formulae.

When $Ne < No$ $$G_{FB}(I) = G_{FB}(I-1) + \Delta G_{FB}$$

Figure 6:
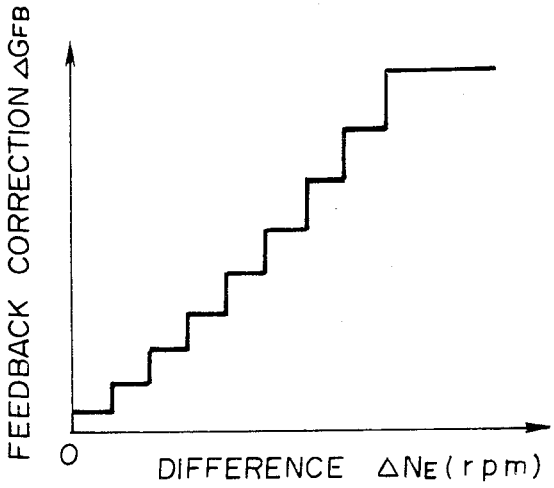
FIG. 6 is a characteristic diagram of a feedback correction coefficient $\Delta G_{FB}$.

When $Ne > No$ $$G_{FB}(I) = G_{FB}(I-1) - \Delta G_{FB}$$

wherein $G_{FB}(0) = 0$, $|G_{FB}| \leqq K$(constant) $\Delta G_{FB}$ represents a feedback correction coefficient and varies according to the difference $\Delta Ne (= No - Ne)$ as shown in FIG. 6. That is, the feedback correction coefficient $\Delta G_{FB}$ is increased as the difference $\Delta Ne$ increases.

Figure 7:
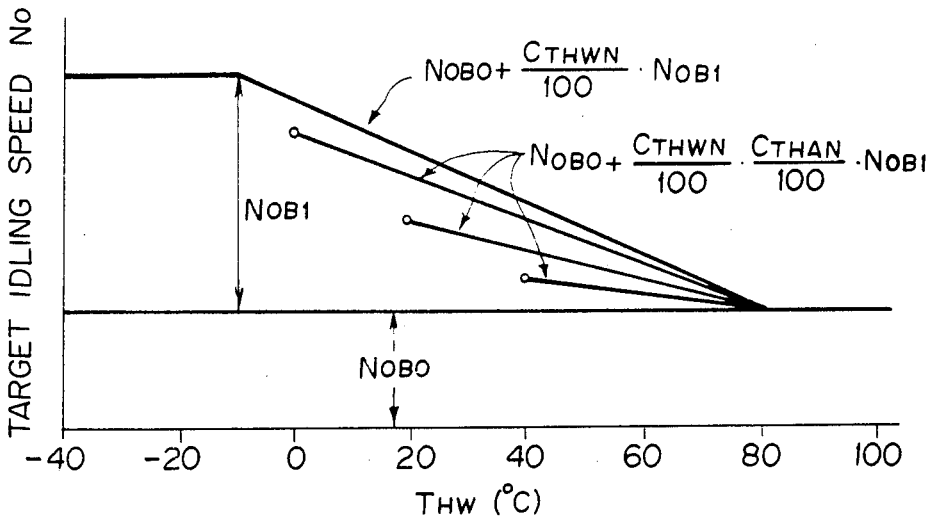
FIG. 7 is a characteristic diagram showing the relation between the cooling water temperature and the target idling speed.

The target idling speed No is calculated from the following formula.

$$No = N_{OBO} + (C_{THWN}/100) \times (C_{THAN}/100) \times N_{OBl} + N_{OL}$$

wherein $N_{OBO}$ represents a target idling speed when the engine is warm, $(C_{THWN}/100)$ represents a correction coefficient for the temperature of the engine cooling water $T_{HW}$, $(C_{THAN}/100)$ represents a correction coefficient for the temperature of intake air $T_{HA}$ that is, for the oil temperature upon staring, $N_{OBl}$ represents a maximum increase of the engine speed for warm-up, and $(C_{THWN}/100) \times (C_{THAN}/100) \times N_{OBl}$ represents the increase of the engine speed for warm-up when the engine is cold. The values of $N_{OBO}$ and $N_{OBl}$ in the case of a manual transmission vehicle and in the case that the transmission is in a range other than D-range in an automatic transmission vehicle differ from the values of $N_{OBO}$ and $N_{OBl}$ in the case that the transmission is in D-range in an automatic transmission vehicle, the latter being larger than the former. $N_{OL}$ represents a load engine speed increase for increasing the engine speed according to load when the engine is loaded, and when two or more of air-conditioner load, power steering system load, electric load and the like simultaneously act on the engine, the load engine speed increases $N_{OL}$ are set only for the loads of higher priority. For example, the air-conditioner load, the power steering load, the electric load have higher priority in this order. The relation between the target idling speed No and the temperature of the engine cooling water $T_{HW}$ is as shown in FIG. 7 and when the temperature of the engine cooling water $T_{HW}$ is detected, the target idling speed can be obtained. The idling speed feedback correction amount of air $G_{FB}$ can be obtained from the difference between the target idling speed No and the actual engine speed Ne. In FIG. 7, the load engine speed increases $N_{OL}$ is omitted.

5. The learning correction amount of air $G_{LRN}$ is for correcting the amount of air when the following conditions are continuously satisfied for five seconds, and is obtained from formula $$G_{LRN}(i) = G_{LRN}(i-1) + (\overline{G_{FB}}/2)$$

$$\text{wherein } G_{FB} = \sum_{J=1}^{N} G_{FB}(J)/N$$

(1) that the operating condition is in the idling speed feedback zone (2) that the transmission is a manual transmission or the transmission is an automatic transmission and the transmission is in a range other than D-range (3) none of air-conditioner load, power steering load, electric load, and the like acts on the engine (4) fluctuation in the engine speed Ne is not larger than ±30 rpm (5) the temperature of the engine cooling water $T_{HW}$ is not lower than 60° C.

(6) The temperature of intake air $T_{HA}$ is not higher than 75° C. That is, when the conditions of learning described above are satisfied, the learning correction amount of air $G_{LRN}$ is set to a value obtained by adding a half of the mean of the idling speed feedback correction amounts of air $G_{FB}$ N in number to the preceding value of $G_{LRN}$. When the conditions of learning are not satisfied, $G_{LRN}=G_{LRN}(i-1)$ and $J=1$.

Figure 8:
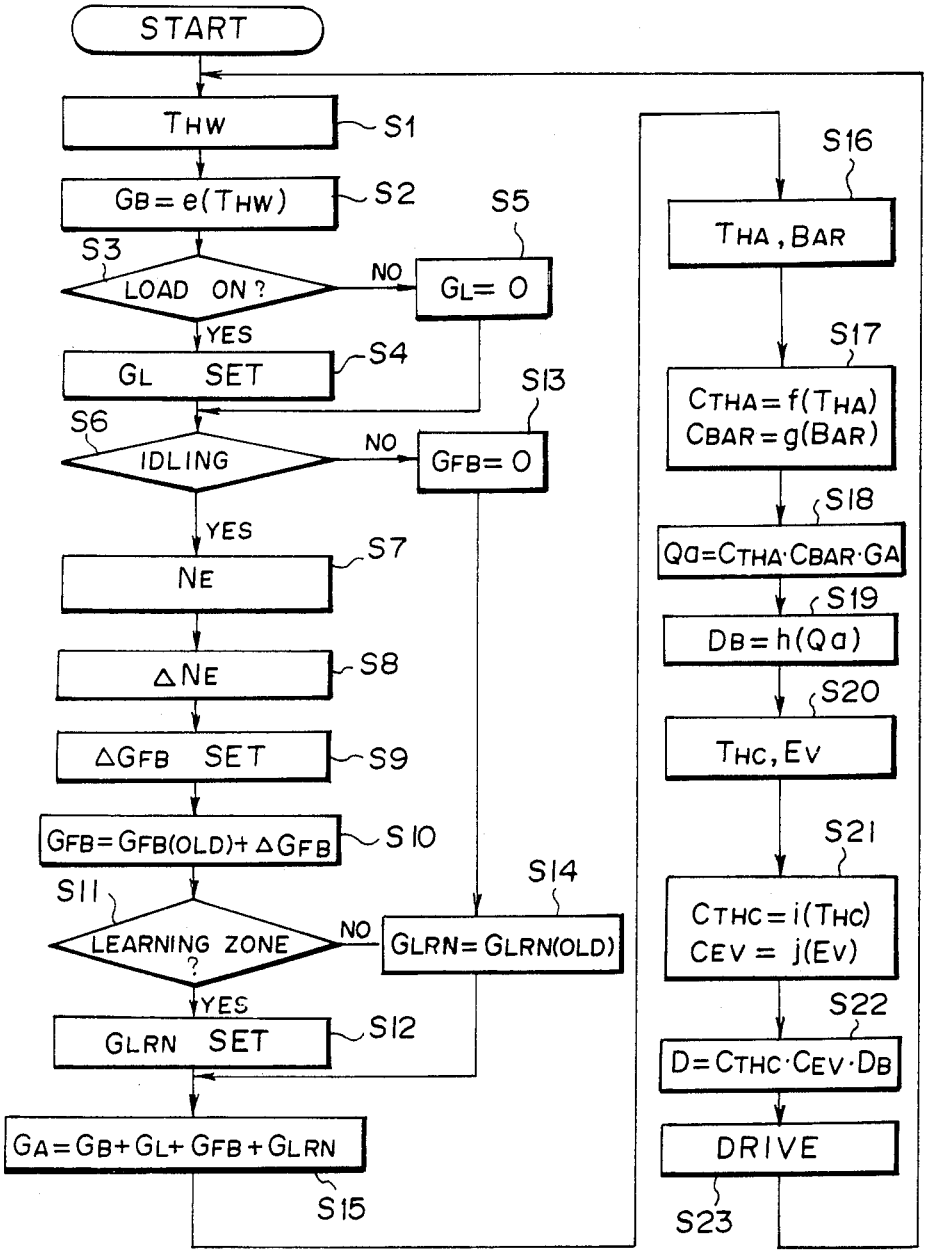
FIG. 8 is a flow chart showing the operation of the control unit.

The operation of the control unit 30 in controlling the control valve 13 will be described with reference to the flow chart shown in FIG. 8, hereinbelow.

In Step S1, the temperature of the engine cooling water $T_{HW}$ is read in, and the base amount of air $G_B$ is calculated from formula $G_B=e(T_{HW})$ (the characteristic diagram shown in FIG. 4) in step S2. In step S3, it is determined whether the engine is loaded. When it is determined that the engine is loaded in the step S3, the load correction amount of air $G_L$ is set according to the engine load in step S4. Otherwise, the load correction amount of air $G_L$ is set to 0 in step S5. Then in step S6, it is determined whether the engine is idling. When it is determined that the engine is idling in the step S6, the engine speed Ne is read in step S7, and the difference ΔNe between the engine speed Ne and the target idling speed No in step S8. In step S9, the feedback correction coefficient $\Delta G_{FB}$ corresponding to the difference ΔNe is obtained from the characteristic diagram shown in FIG. 6. The $\Delta G_{FB}$ is added to the preceding idling speed feedback correction amount of air $G_{FB}$(OLD) to obtain the idling speed feedback correction amount of air $G_{FB}$ for this flowing step S10. Then in step S11, it is determined whether the engine operating condition is in the learning zone. When it is determined that the engine operating condition is in the learning zone in the step S11, the learning correction amount of air $G_{LRN}$ is set according to the idling speed feedback correction amount of air $G_{FB}$ in step S12. Then the control unit 30 proceeds to step S15. On the other hand, when it is not determined in the step S6 that the engine is idling, the idling speed feedback correction amount of air $G_{FB}$ is set to 0 in step S13, and the control unit 30 proceeds to step S14. Also in the case that it is not determined in the step S11 that the engine operating condition is in the learning zone, the control unit 30 proceeds to the step S14. In the step S14, the preceding learning correction amount of air $G_{LRN}$(OLD) is adopted as the learning correction amount of air $G_{LRN}$ for this flow. After the step S14, the control unit 30 proceeds to the step S15. In the step S15, the base amount of air $G_B$, the load correction amount of air $G_L$, the idling speed feedback correction amount of air $G_{FB}$, and the learning correction amount of air $G_{LRN}$ are summed to obtain the target mass flow rate of auxiliary air $G_A$. In step S16, the temperature of intake air $T_{HA}$ and the atmospheric pressure $B_{AR}$ are read, and in step S17, correction coefficients $C_{THA}=f(T_{HA})$ and $C_{BAR}=g(B_{AR})$ for converting the mass flow rate $G_A$ into the volume flow rate Qa are calculated on the basis of the temperature of intake air $T_{HA}$ and the atmospheric pressure $B_{AR}$. The target mass flow rate of auxiliary air $G_A$ obtained in the step S15 is multiplied by the correction coefficients $C_{THA}$ and $C_{BAR}$ thus obtained, thereby obtaining the target volume flow rate of auxiliary air Qa.

Figure 9:
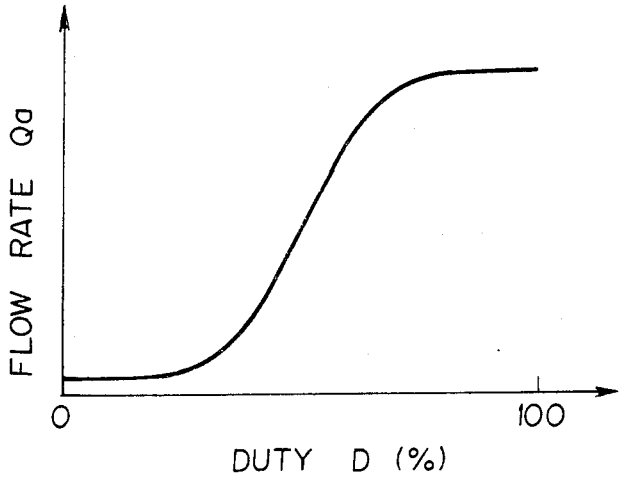
FIG. 9 is a view showing the output characteristics of the control valve.

In step S19, control duty $D_B$ of the control valve 13 is determined by referring the target volume flow rate of auxiliary air Qa to the output characteristics of the control valve 13 shown in FIG. 9. Then the battery voltage $E_V$ and the temperature of the winding (water temperature) $T_{HC}$ are read in step S20. Correction coefficients $C_{THC}=i(T_{HC})$ and $CEV=j(EV)$ are calculated on the basis of the battery voltage $E_V$ and the temperature of the winding $T_{HC}$ in step S21. The control duty $D_B$ is multiplied by the correction coefficients $C_{THC}$ and $C_{EV}$ to obtain a corrected control duty D is $(=C_{THC}\cdot C_{EV}\cdot D_B)$ in step S22. The corrected control duty D is delivered to the control valve 13 to drive it in step S23.

What is claimed:

1. An intake system for an internal combustion engine comprising an intake passage provided with a throttle valve, a bypass passage for feeding auxiliary air to the engine bypassing the throttle valve, a control valve provided in the bypass passage to control airflow through the bypass passage, an operating condition detecting means for detecting the engine operating condition, an auxiliary air requirement calculating means which receives the output of the operating condition detecting means and determines an auxiliary air requirement according to the engine operating condition, a target idling speed determining means which receives the output of the operating condition detecting means and determines a target idling speed, an engine speed detecting means, a feedback correction amount determining means which compares the target idling speed with the actual engine speed detected by the engine speed detecting means and determines a feedback correction amount of auxiliary air according to the difference therebetween, a flow rate determining means which determines the flow rate of auxiliary air on the basis of the sum of the auxiliary air requirement and the feedback correction amount of auxiliary air, a converting means for converting the flow rate into a control amount of the control valve based on the output characteristics of the control valve, and a driving means for controlling the control valve on the basis of the control amount.

2. An intake system as defined in claim 1 in which said control valve is a solenoid valve and said control amount of the control valve is a duty thereof.

3. An intake system as defined in claim 1 in which said operating condition detecting means includes means for detecting load on the engine and said auxiliary air requirement calculating means determines the auxiliary air requirement taking into account the engine load.

4. An intake system as defined in claim 3 in which said means for detecting load on the engine detects a plurality of loads on the engine.

5. An intake system as defined in claim 1 in which said operating condition detecting means comprises an engine temperature sensor and a load sensor for detecting load on the engine, and said auxiliary air requirement calculating means comprises a base air amount calculating means for calculating a base amount of air according to the engine temperature and a load correction air amount calculating means for calculating a load correction air amount according to the engine load, and determines the auxiliary air requirement on the basis of the sum of the outputs of the base air amount calculating means and the load correction air amount calculating means.

6. An intake system as defined in claim 5 further comprising a learning correction calculating means for calculating a learning correction amount of air on the basis of one or more preceding feedback correction amounts of air, said flow rate determining means determining the flow rate of auxiliary air on the basis of the sum of the auxiliary air requirement, the feedback correction amount of auxiliary air, and the learning correction amount of air.

7. An intake system for an internal combustion engine comprising an intake passage provided with a throttle valve, a bypass passage for feeding auxiliary air to the engine bypassing the throttle valve, a control valve provided in the bypass passage to control airflow through the bypass passage, an operating condition detecting means for detecting the engine operating condition, an auxiliary air mass requirement calculating means which receives the output of the operating condition detecting means and determines an auxiliary air mass requirement according to the engine operating condition, a target idling speed determining means which receives the output of the operating condition detecting means and determines a target idling speed, an engine speed detecting means, a feedback correction mass determining means which compares the target idling speed with the actual engine speed detected by the engine speed detecting means and determines a feedback correction mass of auxiliary air according to the difference therebetween, a mass flow rate determining means which determines the mass flow rate of auxiliary air on the basis of the sum of the auxiliary air mass requirement and the feedback correction mass of auxiliary air, a density sensor for detecting the density of intake air, a first converting means which receives the output of the density sensor and converts the mass flow rate of auxiliary air into a volume flow rate taking into account the density of intake air, a second converting means for converting the volume flow rate into a control amount of the control valve based on the output characteristics of the control valve, and a driving means for controlling the control valve on the basis of the control amount.

8. An intake system as defined in claim 7 in which said control valve is a solenoid valve and said control amount of the control valve is a duty thereof.

9. An intake system as defined in claim 7 in which said density sensor detects the density of intake air through the temperature of intake air.

10. An intake system as defined in claim 7 in which said operating condition detecting means includes means for detecting load on the engine and said auxiliary air mass requirement calculating means determines the auxiliary air mass requirement taking into account the engine load.

11. An intake system as defined in claim 10 in which said means for detecting load on the engine detects a plurality of loads on the engine.

12. An intake system as defined in claim 7 in which said operating condition detecting means comprises an engine temperature sensor and a load sensor for detecting load on the engine, and said auxiliary air mass requirement calculating means comprises a base air mass calculating means for calculating a base mass of air according to the engine temperature and a load correction air mass calculating means for calculating a load correction air mass according to the engine load, and determines the auxiliary air mass requirement on the basis of the sum of the outputs of the base air mass calculating means and the load correction air mass calculating means.

13. An intake system as defined in claim 12 further comprising a learning correction calculating means for calculating a learning correction mass of air on the basis of one or more preceding feedback correction masses of air, said mass flow rate determining means determining the mass flow rate of auxiliary air on the basis of the sum of the auxiliary air mass requirement, the feedback correction mass of auxiliary air, and the learning correction mass of air.

* * * * *